United States Patent [19]

Leibowitz

[11] Patent Number: 4,841,871

[45] Date of Patent: Jun. 27, 1989

[54] MODULAR TRANSPORTATION SYSTEM WITH AERODYNAMIC LIFT AUGMENTED TRACTION VEHICLES

[76] Inventor: Martin N. Leibowitz, 11600 Audelia Rd., #187, Dallas, Tex. 75243

[21] Appl. No.: 601,989

[22] Filed: Apr. 19, 1984

[51] Int. Cl.[4] ..... B61B 13/08; E01B 25/22

[52] U.S. Cl. ..... 104/23.1; 104/139; 104/91; 104/94

[58] Field of Search ..... 104/89, 90, 91, 94, 104/23.1 FS, 28, 30, 107, 108, 109, 139; 105/154, 155, 1.1, 1.2, 1.3, 74

[56] References Cited

U.S. PATENT DOCUMENTS

| | | | |
|---|---|---|---|
| 2,598,251 | 5/1952 | Gesner | 104/94 X |
| 3,349,719 | 10/1967 | Young | 104/91 |
| 3,854,406 | 12/1974 | Monne | 104/94 |
| 3,919,944 | 11/1975 | Jorg | 104/23 R |

*Primary Examiner*—Robert B. Reeves
*Assistant Examiner*—Joseph D. Pape
*Attorney, Agent, or Firm*—Richard M. Saccocio

[57] ABSTRACT

A monorail transportation system utilizing generally inverted channel shaped rail members for supporting personal transit vehicles which are each suspended from the rails by a carriage having traction motor propelled drive wheels engageable with the rail channel and spaced apart vehicle supporting guide wheels. The vehicles have aerodynamically contoured bodies provided with lift surfaces which provide varying degrees of lift in accordance with vehicle speed and angle of attack to reduce mechanical friction in the carriage and structural loading on the rail network. The vehicles are automatically controlled and used by individual user when called up from storage track sections at spaced apart stations along the rail network.

10 Claims, 4 Drawing Sheets

MODULAR TRANSPORTATION SYSTEM WITH AERODYNAMIC LIFT AUGMENTED TRACTION VEHICLES

BACKGROUND OF THE INVENTION

1. Field of the Invention

The present invention pertains to a transit system comprising an elevated track or monorail network over which personal or individualized traction vehicles are automatically guided between selected point-to-point travel destinations. The vehicles are traction motor driven and are aerodynamically contoured to provide lift to reduce road and other mechanical system friction and to reduce static loads on the track or rail network.

2. Background

The continued development of private automotive vehicles and surface roadway systems to accommodate them has reached the point of economic and social diminishing returns in the developed nations of the world. Proposals for the development of mass transit systems in undeveloped countries as well as in urban areas of developed countries have focused on the development of rail systems in which large vehicles or trains of vehicles are used to move large numbers of people. This concept is considerably less flexible or convenient than that which is provided by the use of the private automobile.

Certainly there are many problems associated with the further development of roadways and parking space as well as support systems for private automotive vehicles powered by fossil fuels. There has been a continuing need for a transportation system, particularly, in congested urban areas as well as on intercity routes which is less expensive to develop, install, use and maintain and which provides convenience for individual users approaching that of the personal automobile. Consideration for the effects on the environment also dictate the use of less fossil fuels and more use of electric power which can be provided by alternate energy sources. Moreover, there is currently a need for a new concept in a transportation network which will reduce the burden of maintaining and developing the existing transportation infrastructure. The present invention is directed to several improvements in a transportation system concept which offers many benefits of the freedom and convenience of private automotive vehicle transportation systems while alleviating many of the problems associated with the use of private automotive vehicles.

SUMMARY OF THE INVENTION

The present invention pertains to a personal modular transportation system comprising an elevated monorail type network structure forming a trackway for large numbers of personal or individual traction vehicles which are operable to traverse the rail system and are automatically controlled between predetermined point-to-point travel destinations.

In accordance with one aspect of the present invention there is provided an improved monorail system particularly adapted for use in conjunction with personalized monorail traction vehicles which are provided with traction drive motors and wheel means engageable with the rail and wherein structural loading on the rail system and road friction of the vehicle is reduced by aerodynamic lift acting on the vehicles as they traverse the rail system at predetermined operating speeds.

In accordance with another aspect of the present invention there is provided a modular transportation system particularly adapted for individualized vehicle operation wherein personal or individual vehicles are maintained on storage tracks at stations along the system and are automatically placed in service and routed to a predetermined destination by the user of the vehicle. The vehicle is left at a destination station by the user and put into a storage circuit or loop from which spare vehicles are brought into use on demand.

In accordance with another aspect of the present invention there is provided a monorail network having several particularly unique rail interchanges and terminal configurations for routing and controlling traffic flow with large numbers of personal transit vehicles.

Accordingly, it is an object of the present invention to provide a novel transportation system wherein relatively small transit vehicles capable of carrying loads comparable to private automobiles are operable to traverse a monorail network substantially automatically from a point of origin to a predetermined destination as selected by the user and wherein the transit vehicles are propelled by traction motor means and take advantage of aerodynamic lift to reduce road and mechanical system friction and structural loading on the rail system.

It is also an object of the present invention to provide a personalized transportation system particularly adapted for urban transportation networks as well as intercity networks to reduce the requirements for handling and storing personal automotive vehicles and the like. It is a further object of the present invention to provide a transportation system in which vehicle utilization is greater than in personal automobile type transportation systems and wherein vehicles are maintained in use in the system a greater percentage of the time but are automatically controlled to be available at predetermined station storage circuits throughout the system.

Further objects of the present invention include the provision of a transportation system which utilizes an electrical energy source, includes structure which does not become susceptible to hazards associated with weather conditions, darkness, or other hazards typically associated with automotive transportation networks, is relatively cost effective and of lightweight construction due to the reduced fatigue loading resulting from cyclical loading by the vehicles traversing the network and utilizes vehicles which may be constructed to be fairly lightweight. The system may be constructed over existing roadway and railroad rights of way and may be adapted to support utility conductors of various types.

Those skilled in the art will recognize the abovedescribed advantages and features of the invention as well as additional superior aspects thereof upon reading the detailed description which follows in conjunction with the drawing.

DESCRIPTION OF THE PREFERRED EMBODIMENT

Figure 1:
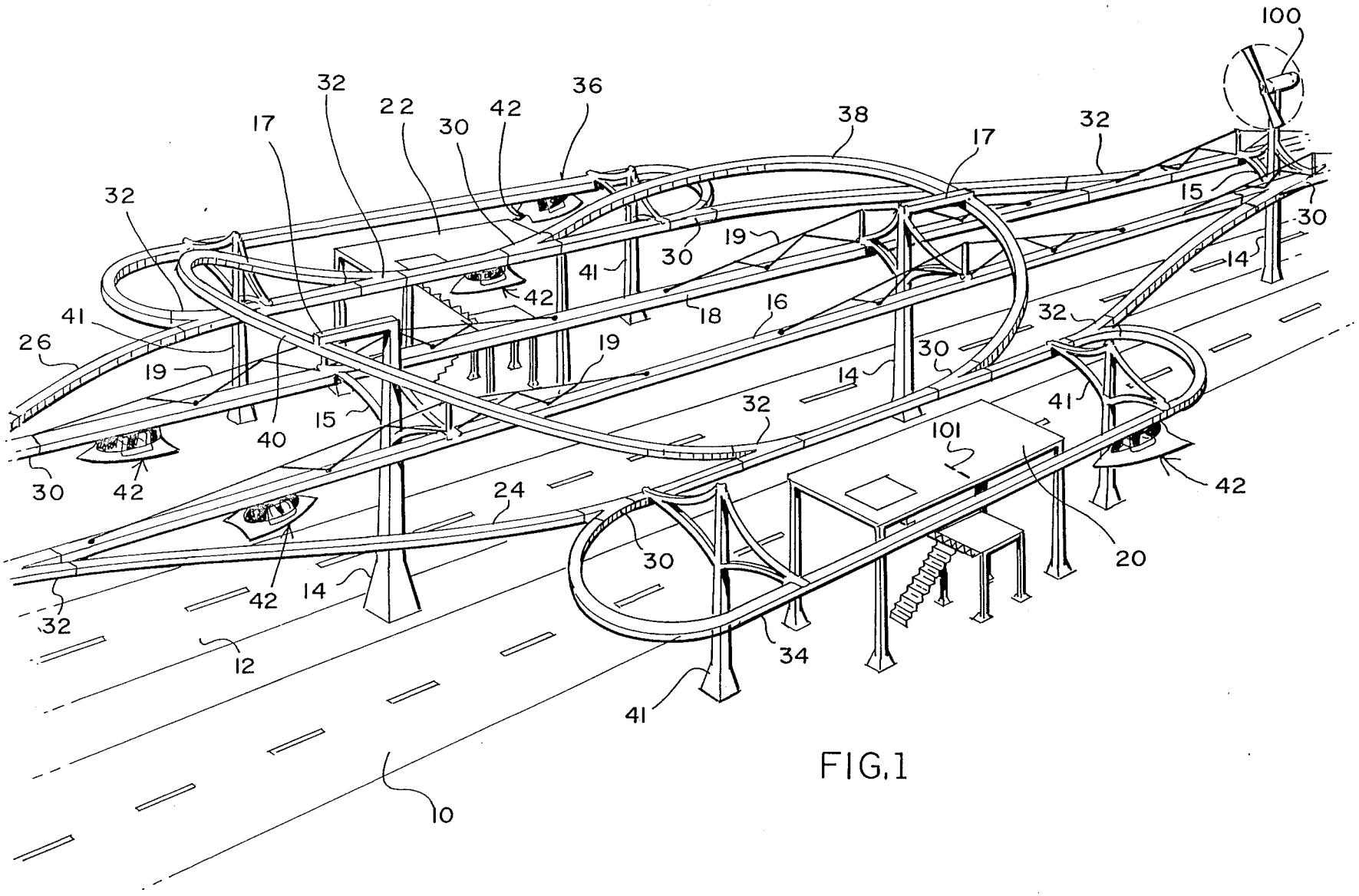
FIG. 1 is a perspective view of a portion of a modular transportation system in accordance with the present invention.

In the description which follows like parts are marked throughout the specification and drawing with the same reference numerals, respectively. The drawing figures are not necessarily to scale and certain features of the invention may be shown in somewhat schematic form in the interest of clarity and conciseness.

Referring to FIG. 1, there is illustrated a portion of a modular transportation system in accordance with the present invention comprising a monorail network wherein the rail right of way may be built over existing automobile roadways 10 and 12, for example. The present invention also contemplates that the rail network may be built over or adjacent to existing intercity railroad rights of way or intercity highways. Clearly, the transportation system of the present invention is most useful in highly congested urban areas wherein a plurality of spaced apart support towers 14 are adapted to support opposed parallel trackways 16 and 18. The trackways 16 and 18 are preferably formed of somewhat inverted channel shaped straight and curved steel or aluminum rail sections which are suitably joined together and suspended from opposed arms 15 of the respective support towers 14. Depending on the span of rail sections of trackways 16 and 18 between the support towers additional support structure in the form of a conventional suspension cable network 19 may be required. However, one advantage of the present invention minimizes the structural loading on the rail system and lighter weight and less costly suspension structure is contemplated as compared with prior art monorail systems.

The portion of the improved transportation system illustrated in FIG. 1 includes a typical system station for each of the trackways 16 and 18 and reverse direction crossover trackways for changing direction of travel on the rail system. For example, exemplary elevated platform type stations 20 and 22 are shown positioned adjacent to respective continuous trackway station sidings 24 and 26. The sidings 24 and 26 are made up of end-to-end joined monorail sections similar to the sections providing the trackways 16 and 18 and are joined to the main line trackways 16 and 18 by suitable left hand and right hand switch sections or turnouts 30 and 32. The detailed structural features of the turnouts 30 and 32 are not illustrated in FIG. 1 and may take various forms. For example, the turnouts may be of the general configuration of the switching devices described in U.S. Pat. 3,118,392 to C. H. Zimmerman. Alternatively, the way in which the track sections merge or diverge from each other at the turnouts 30 and 32 may, in combination with structure of the vehicles utilizing the transportation system be provided with suitable structure and controls similar to that utilized in the automatic railway system known as the AIR TRANS system operated within the confines of the Dallas-Fort Worth Regional Airport, Dallas, Tex., U.S.A. The actual structural details of the switching devices for switching from one trackway to another may take various forms as explained above and are not believed to require a detailed explanation herein in order to enable one to practice the present invention.

In accordance with an aspect of the present invention the modular transportation system is adapted to include at least at selected stations a section of vehicle storage trackway which may be conveniently formed as a closed loop, as shown in FIG. 1, comprising a storage loop trackway 34 for the station 20 and a similar storage loop trackway 36 for the station 22. The storage loop trackways 34 and 36 are interconnected with the station sidings 24 and 26 by respective left hand and right hand turnout or switching sections 30 and 32. Moreover, at selected points along the transportation system reverse direction elevated crossover trackway sections 38 and 40 are preferably provided to enable vehicles traversing the main line trackways 16 and 18 to change direction. The crossover trackway 38 utilizes two turnouts 30 for interconnecting the crossover trackway with the respective station sidings 24 and 26 and the crossover trackway 40 is interconnected with the station sidings 24 and 26 with respective turnouts or switching sections 32, respectively. At least some of the track sections making up the crossover trackways 38 and 40 must be curved in two directions and the station siding trackways 24 and 26 are also made up of track sections which are curved in at least one plane.

The crossover trackways 38 and 40 or similar crossovers, not shown, may be used at terminal ends, not shown, of the trackways 16 and 18 as required. The actual detailed construction of the respective track sections making up the various curved portions of the transportation system trackways are not believed to require further detailed explanation for the purposes of the present invention. As shown in FIG. 1, the support towers 14 are preferably adapted to include additional support arms 17 for supporting the respective crossover trackways 38 and 40. Additional support towers 41 similar to the support towers 14 are, of course, required for supporting the sidings 24 and 26 and the station storage loop track sections 34 and 36.

Figure 2:
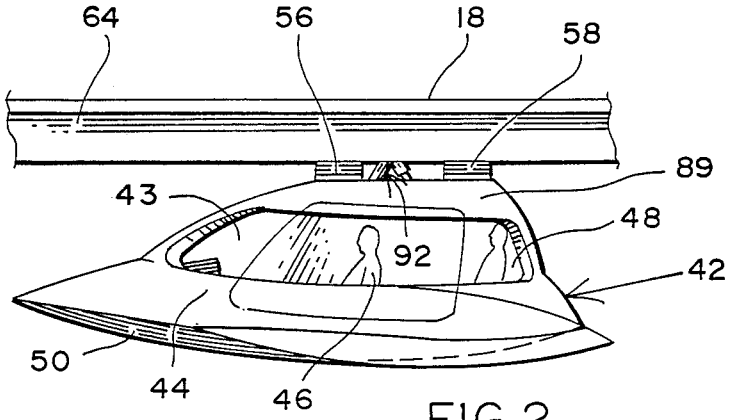
FIG. 2 is a side elevation of an improved personal or individualized transit vehicle for the system of the present invention.
Figure 3:
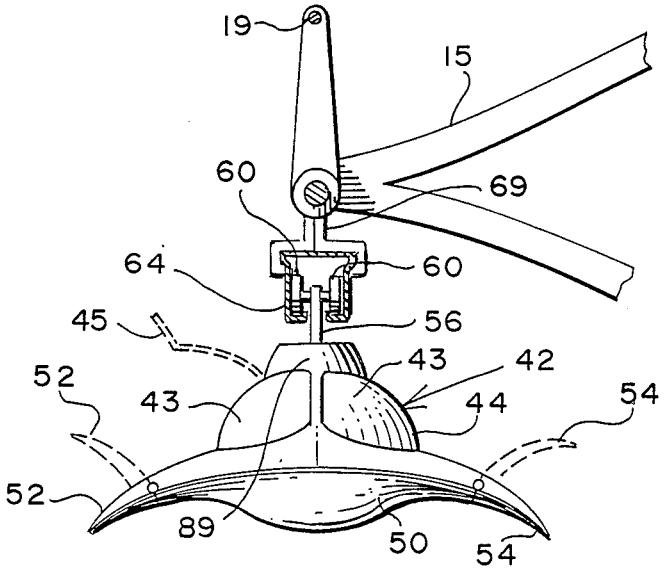
FIG. 3 is a front elevation of the vehicle.
Figure 4:
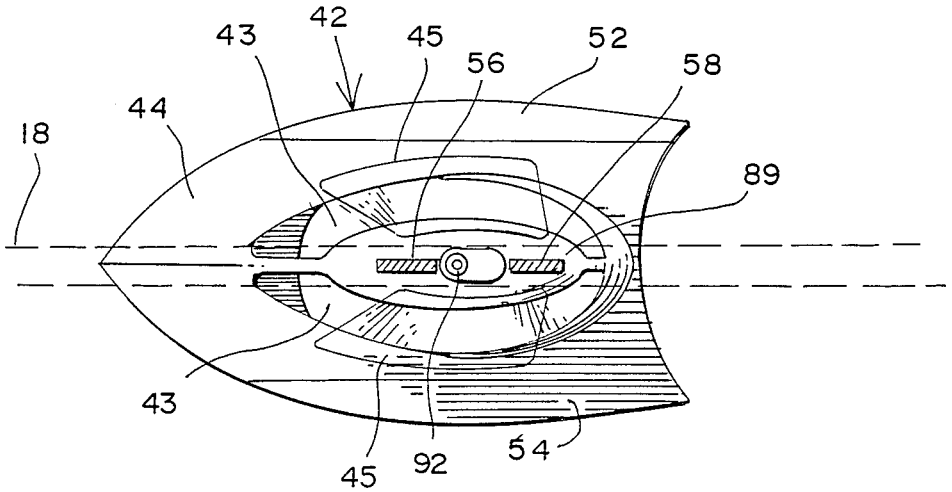
FIG. 4 is a top plan view of the vehicle.

Referring now to FIGS. 2, 3 and 4 also, the modular transportation system of the present invention contemplates that the monorail network is adapted to utilize a substantial number of personal or individualized automatically controlled, self propelled vehicles, each generally designated by the numeral 42. The vehicles 42 each comprise a body 44 forming a cabin having windows 43, interior seating 46 for at least two persons and additional seating or storage compartment space 48 within the cabin interior for accommodating personal items of luggage. The body 44 has a generally deltoid shape as illustrated, and is aerodynamically contoured to provide a lift surface 50 which may be adjusted as to its configuration by longitudinal hinged outboard opposed winglet sections 52 and 54. The winglet sections 52 and 54 may be adjusted to control the amount of lift imparted to the vehicle 42 as it is traversing a trackway. An alternate position of the winglet sections 52 and 54 is illustrated in FIG. 3 to indicate one manner of controlling lift on the vehicle 42 during forward motion thereof. Additional lift augmenting or lift spoiling devices may be utilized to control the aerodynamic characteristics of the vehicle 42 as it traverses the trackways. Passenger ingress and egress with respect to the vehicle 42 may be obtained through opposed gull wing doors 45.

Figure 5:
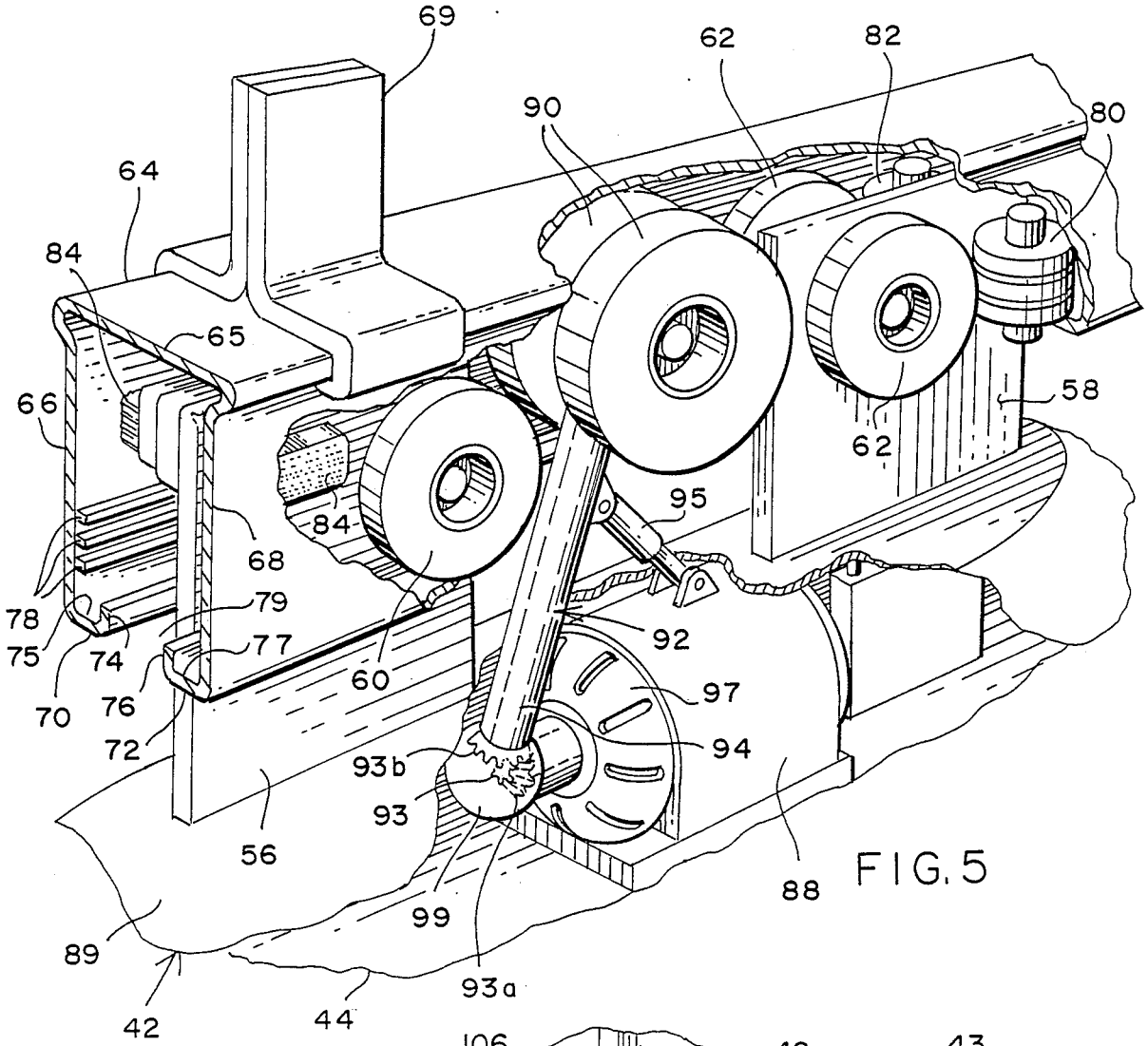
FIG. 5 is a perspective view of the suspension carriage and traction motor mechanism for the vehicle illustrated in FIGS. 2 through 4.

Referring also to FIG. 5, the vehicle 42 includes generally vertically extending fore and aft support strut members 56 and 58 which connect the vehicle body 44 to a propulsion carriage portion of the vehicle including spaced apart sets of dual pneumatic tired guide wheels 60 and 62 suitably rotatably supported on the strut members 56 and 58 and adapted for traversal of the trackways 16 and 18 of the transportation system. FIG. 5 also illustrates a typical section of trackway comprising an inverted somewhat channel shaped track section 64 having a top web portion 65 opposed flanges 66 and 68, spaced apart bottom web portions 70 and 72 and reentrant flange portions 74 and 76 forming opposed troughs 75 and 77 for guiding the wheels 60 and 62. A longitudinal slot 79 is formed between the bottom web 70 and 72 through which the strut members 56 and 68 extend. A typical clamp assembly 69 is shown in FIGS. 3 and 5 for attaching the trackways to the support tower 14 in a suitable manner. The trackways 16, 18, 24, 26, 34, 36 and 40, and including the track section 64, also include a suitable arrangement of elongated continuous electrical control and power supply conductors, generally designated by the numeral 78, which may extend along the interior of the flange 66, as shown, and/or flange 68. The carriage support strut member 58 is adapted to support opposed electrical pickup or contact shoe means 80 and 82 for continuous engagement with the control and power supply conductor arrangement 78 in a conventional manner. Lateral guidance of the vehicle 42 in the track section 64 may be controlled by the wheels 60 and 62 which are generally confined laterally in the troughs 75 and 77 and by other suitable guide means, not shown. Braking action may be accomplished by traction motor control and wheel braking or opposed brake shoes 84 supported on the carriage support strut member 56 and extensible into engagement with the track flanges 66 or 68 to provide suitable braking effort as well as stabilization of the vehicle if aerodynamic buffeting should occur.

The vehicles 42 are each provided with a unique traction motor and drive arrangement which, as shown in FIG. 5, includes a suitable electric traction motor 88 which may be mounted on the vehicle body 44 between the support strut members 56 and 58 and enclosed by a cowl 89. The motor 88 is operably connected to a traction bogey including a pair of spaced apart pneumatic tired drive wheels 90 disposed in the channel formed by the track section 64 and adapted to be in constant engagement with the top web 65. The traction drive wheels 90 are drivably connected to the motor 88 through a suitable drive mechanism, generally designed by the numeral 92 including a support housing 94. The drive mechanism 92 may include, for example, a bevel gear drive 93 and a shaft 97 disposed in the housing 94 which housing is hinged at 99 to motor 88. The bevel gear drive 93 may include a gear 93a connected to motor 88 and a gear 93b connected to shaft 97. The drive mechanism 92 is adapted to provide for slight vertical movement of the vehicle 42 relative to the traction drive wheels 90 so that when aerodynamic lift exceeds the weight of the vehicle the guide wheels 60 and 62, typically leave contact with the track web portions 70 and 72 or at least only maintain very light contact with the web portions. In this regard, it is important that the traction wheels 90 maintain substantially constant forcible engagement with the track web section 65. In this regard also, the vehicle 42 is provided with a pressure fluid cylinder and piston type actuator 95 interconnecting the drive mechanism support housing 94 with the vehicle 42 and adapted to urge the drive wheels 90 in substantially constant pressure engagement with the web 65 regardless of the lift imparted to the vehicle 42. The cylinder 95 may be operably connected to a source of pressure fluid, not shown, at a constant regulated pressure.

An important aspect of the present invention resides in the provision of the vehicle 42 which has the aerodynamically shaped body 48 and lifting surface 50 which reduces the generally downward static loading on the trackways of the transportation system during traversal of the vehicles 42 thereover. Accordingly, the entire structure of the track system may be built with a safety factor which does not require taking into consideration cyclical loads on the track system which are as great as with conventional monorail structures. Moreover, the road friction and mechanical friction generated by and encountered by the guide wheels 60 and 62 during high speed traversal of the vehicles 42 over the system trackways is reduced and propulsion efficiency is increased for the respective vehicles.

The transportation system of the present invention may utilize electrical power from various sources including central station power supplies, not shown, or, for example, solar or wind power generator means as indicated at 100 in FIG. 1. For example, spaced apart wind powered generators 100 may be mounted on selective ones of the support towers 14 for generating electrical energy to be input to the system grid through suitable controls, not shown.

The present invention contemplates that the vehicles 42 are automatically controlled in accordance with traffic on the main trackways 16 and 18, the crossover sections 38 and 40, the station sidings 24 and 26 and the storage loop sections 34 and 36 for metering traffic flow between the respective sections and controlling spacing of the vehicles 42 as they traverse the system. This automatic control is believed to be within the scope of one skilled in the art and may be similar to automatic control systems currently used in rail systems such as the aforementioned AIR TRANS system.

However, a particularly advantageous aspect of the transportation system of the present invention resides in the provision of a sufficient number of vehicles 42 which may be maintained stored at selected points along the system such as at the stations 20 and 22 on the storage loop track sections 34 and 36. For example, when a user of the system desires to embark from the station 20, a suitable user encoded card would be inserted in a control unit, not shown, to call up a vehicle 42 parked on the storage loop 34. A vehicle 42 would automatically proceed to a parking position at 101, FIG. 1, for example, for vehicle loading.

Figure 6:
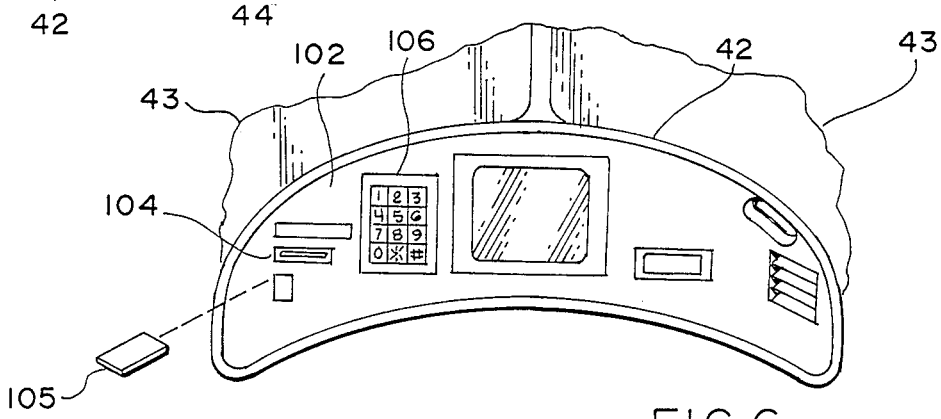
FIG. 6 is a detail view of an instrument panel for the vehicle illustrated in FIGS. 2 through 4.

Referring briefly to FIG. 6, there is illustrated an interior control panel for one of the vehicles 42 in somewhat schematic form. The control panel, generally designated by the numeral 102, is typically provided with means 104 for receiving and reading the aforementioned encoded card 105 and a destination selector digital keyboard panel 106. Upon entry into the vehicle 42, the user would insert the card 105 into the reader 104 and select a destination on panel 106 in accordance with a predetermined destination code. Upon selection of the destination code the vehicle 42, if secured for travel, would automatically progress from position 101 to the siding 24, leave station 20 and enter the main trackway 16 and proceed to the destination selected under automatic control. Upon arriving at a destination station the user would disembark from the vehicle 42 and the vehicle would proceed into a storage loop section such as the storage sections 34 and 36 illustrated in FIG. 1. If a storage section was already full of vehicles, such as might occur in a business or commercial district during business hours, the vehicle would be automatically routed to the next available storage loop or siding. The speed of respective vehicles 42 throughout the transportation system would, of course, be automatically controlled to maintain a predetermined spacing between vehicles on any section of trackway and to prevent collision between vehicles entering or leaving a siding or entering or leaving a crossover section, for example.

The aforementioned user card 105 would be either a purchased item from a suitable vending or dispensing apparatus or would be issued through a billing system wherein the user's charges for utilization of a vehicle would be automatically accounted for and billed to the user periodically.

Figure 7:
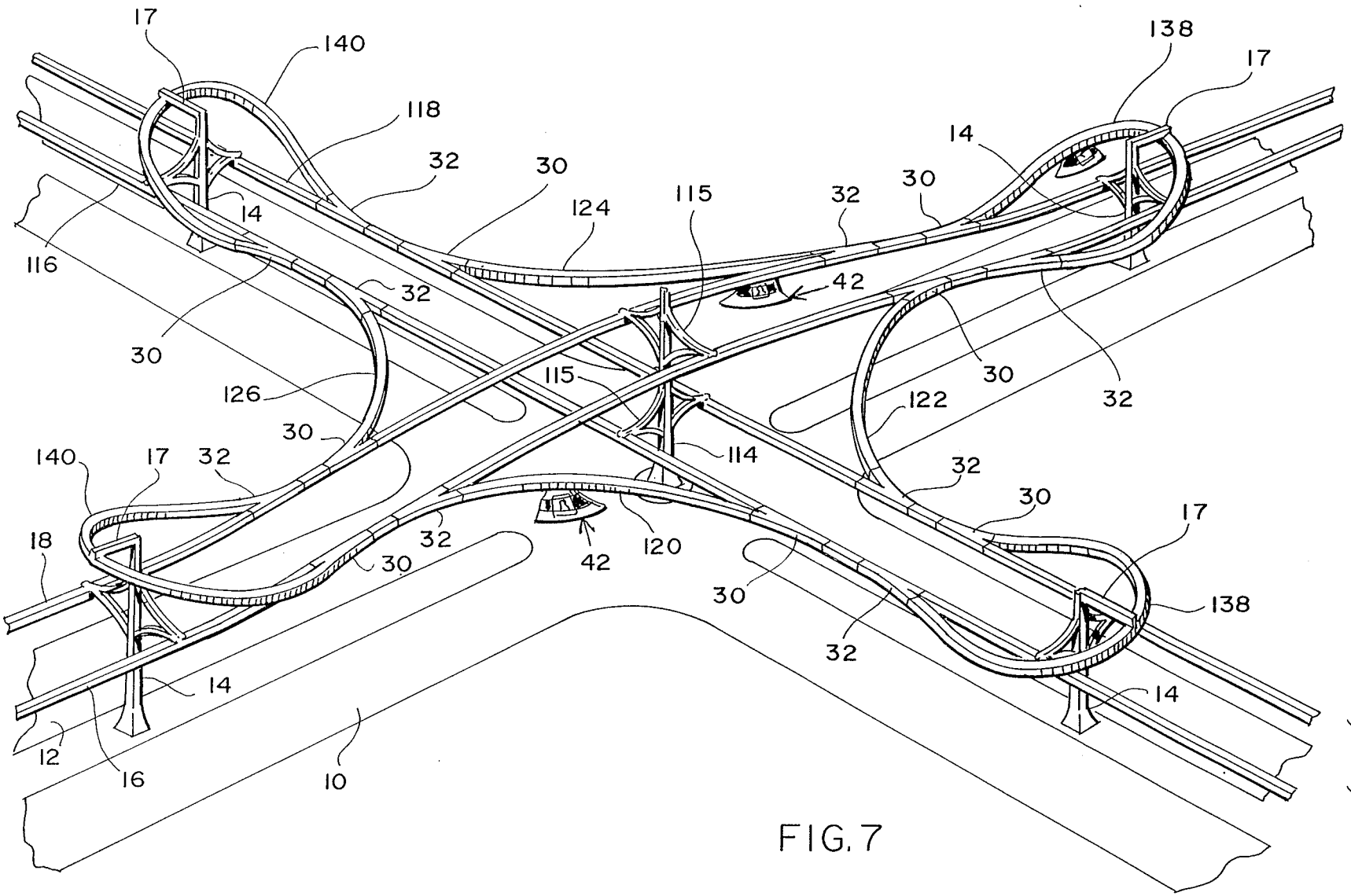
FIG. 7 is a perspective view of an interchange between intersecting railways of the system of the present invention.

Referring now to FIG. 7, there is illustrated a preferred form of an intersection of main line trackways 16 and 18 with other trackways 116 and 118. The trackways 16, 18, 116 and 118 are supported at spaced apart intervals by support towers 14 and at the intersection itself by a support tower 114 having respective support arms 115 projecting from the lower trunk 117 to support the respective trackways. The trackway 16 is interconnected with the trackway 116 by a curved turning section 120. In like manner, the trackway 118 is interconnected with the trackway 16 by a curved section 122, trackway 18 is interconnected with trackway 118 by curved section 124 and trackway 116 is interconnected with trackway 18 by a curved section 126. Each of the curved sections 120, 122, 124 and 126 are interconnected with the respective main track sections by turnouts 30 and 32 as illustrated. Accordingly, a vehicle progressing along any of mainline trackways 16, 18, 116 or 118 could make a right turn on to the appropriate intersecting trackway through a selected one of curved sections 120, 122, 124 or 126.

Each of the trackway pairs 16, 18 and 116, 118 are interconnected by reverse direction crossover sections 138 and 140 as illustrated whereby direction may be reversed or appropriate left turns may be effected at an intersection such as the intersection illustrated in FIG. 7. For example, assume that the trackway 16 proceeds north, trackway 18 proceeds south and trackways 116 and 118 proceed east and west, respectively. A vehicle 42 traveling north and desiring to turn west at the intersection illustrated in FIG. 7 would remain on trackway 16 until approaching the crossover section 138 associated with trackway 16 and 18. The vehicle 42 would automatically, in accordance with its predetermined destination entry code enter the crossover section 138 to reverse its direction thereby proceeding for a short distance south along trackway 18 until encountering the turnout 32 associated with the turn section 124 whereupon the vehicle would enter the turn section 124 and then enter the main trackway 118 westbound. Accordingly, the elevated crossover and reversing track sections 138 and 140 provide for reversing direction on a main thoroughfare as well as providing for entering a curved right angle turn section to change directions at a traffic interchange.

Although two segments of a transportation system rail network in accordance with the present invention have been described in detail herein those skilled in the art will appreciate that various modifications may be made to the rail network to accommodate particular directional change requirements, to provide for storage of vehicles, and to provide stations in high traffic density areas which may accommodate more vehicles for loading and unloading at one time such as a multiplicity of parallel side-by-side or vertically separated loading and unloading platforms.

Furthermore, those skilled in the art will recognize that the specific construction of the vehicle 42 may take various forms without departing from the inventive concept. For example, the system may be modified as to the detailed construction of the vehicle suspension carriage, the provision of vehicles primarily adapted for cargo or freight hauling, and, of course, vehicles for transporting relatively large numbers of persons and freight combined. These various substitutions and modifications may be made without departing from the scope and spirit of the invention recited in the appended claims.

What I claim is:

1. An elevated monorail transport system including at least a main trackway adapted to support a plurality of vehicles for traversal along said trackway, said vehicles each comprising traction carriage means including support wheels for supporting said vehicle on said trackway, propulsion motor means and propulsion wheel means continuously engaged with a portion of said trackway for propelling said vehicle along said trackway, said vehicle also comprising a body connected to said traction carriage means and having an aerodynamic lift surface formed thereon for providing lift forces during traversal of said vehicle along said trackway to reduce friction forces acting on said support wheels and vehicle induced structural loading on said trackway, said vehicle includes means for biasing said propulsion wheel means in engagement with said trackway during the lifting process of the vehicle with respect to said trackway, said trackway comprises means forming a continuous channel shaped member including a top web, opposed flanges, and opposed bottom webs defining a slot between said bottom webs, and said traction support wheels comprise a pair of spaced apart support wheel assemblies engageable with said bottom webs for supporting said vehicle on said trackway, and said traction wheel means is supported on said vehicle for continuous engagement with said top web for propelling said vehicle along said trackway.

2. The transport system set forth in claim 1 wherein: said trackway includes opposed parallel mainline track sections supported on spaced apart support towers, vehicle embarkation and disembarkation stations including a closed loop storage trackway section connected to said main line track sections, respectively, for storing unused vehicles, and means for switching said storage trackway sections in and out of communication with said main line track section for receiving and discharging vehicles from said storage sections.

3. The transport system set forth in claim 2 wherein: said trackway includes a continuous siding interconnecting each of said mainline track sections with said storage track sections at said stations.

4. The transport system set forth in claim 3 wherein: said trackway includes opposed crossover track sections interconnecting opposed sidings for transferring vehicles from one mainline track section to the other mainline track section.

5. The transport system set forth in claim 1 wherein:

said trackway includes plural pairs of opposed parallel single track sections, said pairs of track sections meeting at an intersection and being vertically separated one pair from the other at said intersection;

connecting right hand track sections for connecting a track section of one pair and a track section of another pair; and crossover track sections interconnecting opposed track sections of a pair at points along said track sections of said pair with respect to said right hand track sections to provide for a vehicle to exit a track section of one pair and enter a selected one of the opposed track sections of said one pair and a track section of the other pair.

6. An elevated monorail transport system including a main trackway adapted to support a plurality of vehicles for traversal along said trackway, said trackway comprising opposed parallel mainline track sections supported on spaced apart support towers, vehicle embarkation and disembarkation stations including a closed loop storage trackway section connected to said mainline track sections, respectively, for storing unused vehicles, and a continuous siding interconnecting each of said mainline track sections with said storage track sections at said stations.

7. The transport system set forth in claim 6 wherein:

said trackway includes opposed crossover track sections interconnecting opposed sidings for transferring vehicles from one mainline track section to the other mainline track section.

8. In an elevated monorail transport system including at least a main trackway adapted to support a plurality of vehicles for traversal along said trackway, a vehicle comprising traction carriage means including support wheels for supporting said vehicle on said trackway, propulsion motor means drivably connected to propulsion wheel means continuously engaged with a portion of said trackway for propelling said vehicle along said trackway, and a body connected to said traction carriage means and having an aerodynamic lift surface formed thereon for providing lift forces during traversal of said vehicle along said trackway to reduce friction forces acting on said support wheels and vehicle induced structural loading on said trackway, means for continuously biasing said propulsion wheel means in engagement with said trackway during the lifting process of the vehicle with respect to said trackway, said support wheels comprise a pair of spaced apart support wheel assemblies engageable with a first web of said trackway for supporting said vehicle on said trackway, and said traction wheel means is supported on said vehicle for continuous engagement with an opposed and spaced second web for propelling said vehicle along said trackway.

9. In an elevated monorail transport system including at least a main trackway adapted to support a plurality of vehicles for traversal along said trackway, a vehicle comprising traction carriage means including support wheels for supporting said vehicle on said trackway, propulsion motor means drivably connected to propulsion wheel means continuously engaged with a portion of said trackway for propelling said vehicle along said trackway, and a body connected to said traction carriage means and having an aerodynamic lift surface formed thereon for providing lift forces during traversal of said vehicle along said trackway to reduce friction forces acting on said support wheels and vehicle induced structural loading on said trackways, means for continuously biasing said propulsion wheel means in engagement with said trackway during the lifting process of the vehicle with respect to said trackway, said trackway comprising a continuous channel shaped member, said support wheels riding on a first flange of said channel shaped member and said propulsion wheel means riding on a second flange of said channel member, said first and second flanges being spaced apart from each other.

10. In an elevated monorail transport system including at least a main trackway adapted to support a plurality of vehicles for traversal along said trackway, a vehicle comprising traction carriage means including support wheels for supporting said vehicle on said trackway, propulsion motor means drivably connected to propulsion wheel means continuously engaged with a portion of said trackway for propelling said vehicle along said trackway, and a body connected to said traction carriage means and having an aerodynamic lift surface formed thereon for providing lift forces during traversal of said vehicle along said trackway to reduce friction forces acting on said support wheels and vehicle induced structural loading on said trackway means for continuously biasing said propulsion wheel means in engagement with said trackway during lifting of said vehicle relative to said trackway, said trackway comprising a continuous channel shaped member, said support wheels and said propulsion wheel means being positioned within said channel shaped member and reacting against said channel shaped member in opposite directions.

* * * * *

UNITED STATES PATENT AND TRADEMARK OFFICE

CERTIFICATE OF CORRECTION

PATENT NO. : 4,841,871

DATED : June 27, 1989

INVENTOR(S) : Martin N. Leibowitz

It is certified that error appears in the above-identified patent and that said Letters Patent is hereby corrected as shown below: Title page:

The correct, current address of the inventor is:

Martin N. Leibowitz
1155 Hillsboro Mile
(A1A) Suite 602
Hillsboro Beach, Florida 33062

Signed and Sealed this

Ninth Day of January, 1990

*Attest:*

JEFFREY M. SAMUELS

*Attesting Officer*

*Acting Commissioner of Patents and Trademarks*